US005694785A

United States Patent [19]

Balentine

[11] Patent Number: 5,694,785

[45] Date of Patent: Dec. 9, 1997

[54] CONDENSATE EVAPORATOR APPARATUS

[75] Inventor: Dan Balentine, Costa Mesa, Calif.

[73] Assignee: Fisher Manufacturing Co., Inc., Los Angeles, Calif.

[21] Appl. No.: 712,862

[22] Filed: Sep. 18, 1996

[51] Int. Cl.[6] ..... F25D 21/06; F25D 21/14; F25D 23/06

[52] U.S. Cl. ..... 62/275; 62/274; 62/286

[58] Field of Search ..... 62/274, 275, 285, 62/288, 291, 286

[56] References Cited

U.S. PATENT DOCUMENTS

| | | | |
|---|---|---|---|
| 2,089,953 | 8/1937 | Gaugler | 62/275 |
| 2,667,042 | 1/1954 | Anderson | 62/275 |
| 2,709,900 | 6/1955 | Zearfoss | 62/288 |
| 3,059,446 | 10/1962 | Constantini et al. | 62/275 |
| 3,280,580 | 10/1966 | Constantini et al. | 62/275 |
| 3,412,571 | 11/1968 | Bolynn | 62/274 |
| 3,679,867 | 7/1972 | Canter | 62/291 |
| 3,750,418 | 8/1973 | Maudlin | 62/290 |
| 4,431,905 | 2/1984 | Slocum | 219/274 |
| 4,783,971 | 11/1988 | Alba | 62/291 |
| 4,829,780 | 5/1989 | Hughes et al. | 62/288 |
| 5,279,360 | 1/1994 | Hughes et al. | 165/111 |
| 5,341,653 | 8/1994 | Tippmann et al. | 62/288 |
| 5,341,870 | 8/1994 | Hughes et al. | 165/110 |

FOREIGN PATENT DOCUMENTS

| | | | |
|---|---|---|---|
| 2111183 | 6/1983 | United Kingdom | 62/288 |

*Primary Examiner*—William Doerrler
*Attorney, Agent, or Firm*—Walter A. Hackler

[57] ABSTRACT

A condensate evaporator apparatus in accordance with the present invention generally includes a dissipator pan for collecting condensate formed on evaporator coils of a refrigeration unit, a heating element for hastening evaporation of the condensate, a frame for housing the dissipator pan, the frame including means for permanently mounting the frame within the refrigeration unit, and structure for enabling the dissipator to be quickly and easily removed from the frame in order to facilitate maintenance, cleaning or replacement thereof. In addition, a magnetized float and guide stem may be included for detecting a level of condensate and for activating the heating element when the condensate has accumulated to a selected level.

11 Claims, 2 Drawing Sheets

FIG. 2.
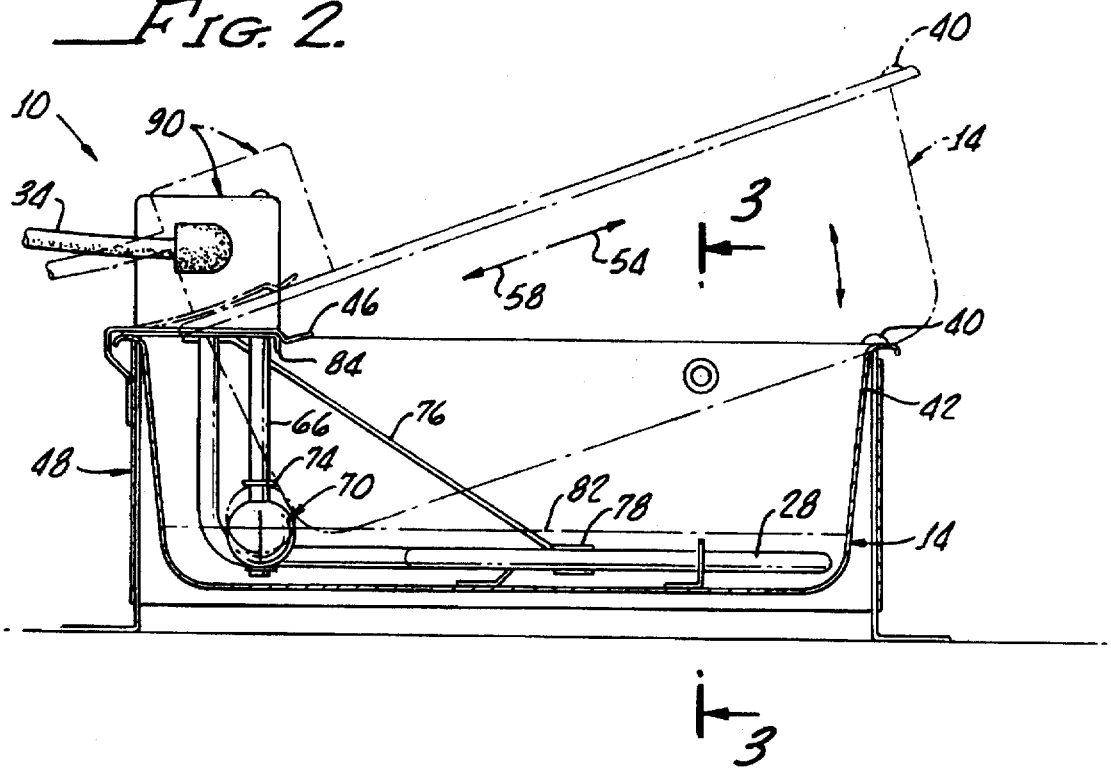
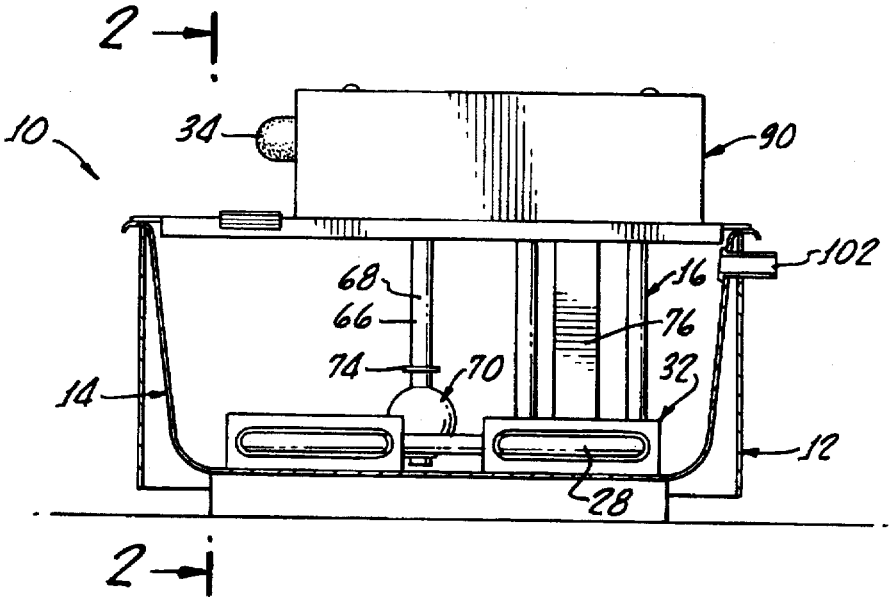
FIG. 3.

CONDENSATE EVAPORATOR APPARATUS

The present invention relates to an apparatus for evaporation of condensate in a refrigeration unit and more specifically to a condensate evaporator apparatus including a utility frame for facilitating maintenance and cleaning of the apparatus.

As is well known, commonly employed air conditioning and refrigeration systems operating on a vapor compression cycle utilize evaporators as a means of cooling the air. A refrigerant is flowed through an evaporator and expanded therein. In doing so, the refrigerant absorbs the heat of vaporization, thereby cooling the medium with which it is in contact, typically, heat exchanger tubes. The heat exchanger tubes sometimes include fins or the like for improved heat transfer. The air to be cooled is flowed over these tubes and fins, and as a result, the local air will be cooled beyond its dew point. As a result, water will condense out of the air onto the fins and tubes. This condensate must be removed or otherwise it will freeze and plug the air flow path.

A simple form of condensate removal involves the use of gravitational forces; in other words, the condensate is allowed to drop as it is formed, into a drain or if no drain is available, into a dissipator. Alternatively, the condensate may be removed to a dissipator by a pump.

A number of refrigeration systems, such as refrigerated display cases for perishable merchandise, are designed with a drip pan for collecting condensate. Typically, the drip pan is a component of a condensate evaporator apparatus for both collecting and vaporizing the condensate. Vaporization is accomplished by use of an electrical heating element within the drip pan. In such condensate evaporators, timing devices or liquid level sensing devices are provided for controlling the heating mechanism.

For safety and health reasons, the condensate evaporator must be regularly cleaned to removed air borne contaminants, mineral deposits and other debris accumulated therein. If not cleaned thoroughly on a consistent basis, accumulated debris could cause failure of the device through corrosion of essential components. For example, corrosion of the timing device which controls the heating element could cause the timing device to fail and consequently, the heating element may continue operation after the drip pan has been emptied. This may cause a risk of overheating.

Another concern is that the accumulation of noxious cleaning fluids, food residue and other debris coupled with the moist environment of the drip pan may contribute to unhealthful, unsanitary conditions within the refrigeration unit. In extreme cases where cleaning of the evaporator pan has been neglected, spoiling and contamination of displayed merchandise is possible. Lack of regular cleaning may lead to offensive odors in the refrigeration unit, driving away potential customers of displayed merchandise.

Regular maintenance is not only necessary for reasons of safety, but will conserve energy and prolong the useful life of the evaporator unit.

Unfortunately, conventional refrigeration units are built such that regular maintenance of the condensate evaporator is difficult. The evaporator pan and heating elements are built into the refrigeration unit as a permanent part thereof.

Most often, the drip pan is merely wiped with a sponge or rag without actually being clearly visible to the person performing the task. Unseen sharp edges and loose electrical wires present a potentially dangerous situation. In conventional refrigeration units of the type described, power to the unit should be temporarily disconnected for safety reasons during cleaning of the evaporator pan.

Although it is imperative that the condensate evaporator be kept clean and in working order, maintenance is often neglected because of the difficulty and inconvenience associated therewith.

Once debris has been allowed to accumulate for a considerable time, a more thorough cleaning and inspection is necessary, which can only be performed after complete removal of the drip pan and associated heating components from the refrigeration unit. This is a complicated task in itself. In some instances, the entire refrigeration unit may need to be shipped to its manufacturer which is equipped with means for disassembling the unit.

A thorough cleaning of a condensate evaporator, or a repair of an inoperative condensate evaporator or any failed components thereof, often requires shutdown of the entire unit while the evaporator is being cleaned or repaired. In many instances, a substitute refrigeration unit is required for use during the cleaning or repair process.

Clearly, it would be far more convenient to be able to simply remove an inoperative condensate evaporator, including the heating element, and slide into the refrigeration unit, an operative replacement therefor. Meanwhile, the inoperative evaporator may be cleaned or repaired as necessary. Conventional refrigeration units and condensate evaporators have not been designed for such convenience.

A primary objective of the present invention, therefor, is to provide a condensate evaporator apparatus that enables the evaporator pan and heating element to be freely removed from a refrigeration unit without the need for special tools or complicated procedures.

SUMMARY OF THE INVENTION

Accordingly, it is an object of the present invention to provide an improved condensate evaporator apparatus for use in refrigerated storage enclosures, particularly, portable refrigerated storage enclosures or those without access to a drain.

A condensate evaporator apparatus, in accordance with the present invention, generally comprises a dissipator for receiving a condensate, means for hastening evaporation of the condensate accumulated in the dissipator, a frame for housing the dissipator, including means for permanently securing the frame within a refrigeration unit, and means for fastening the dissipator within the frame in order to enable the dissipator to be freely inserted into and removed from the refrigeration unit, thus facilitating cleaning, maintenance and replacement of the dissipator.

Particularly, the frame may comprise a rigid structure having sidewalls and mounted by means of screws, welding or the like within the refrigeration unit at a location effective for allowing the dissipator to receive condensate dropping from evaporator coils or being pumped thereto.

The dissipator comprises a pan having a width ahd length sufficient to capture dropping or pumped condensate. The dissipator and frame substantially conform to each other in dimension.

In order to achieve stability of the dissipator while disposed in the frame, and yet enable easy removal of the dissipator therefrom, the apparatus of the present invention includes means for removably attaching the dissipator within the frame. More particularly, the means for removably attaching may include a pair of quick release fasteners disposed on a proximal end of the dissipator and a resilient clip disposed on a distal end of the frame means. Removal of the dissipator from the refrigeration unit involves the simple steps of lifting, or turning the quick release fasteners, and simultaneously sliding the dissipator from under the resilient clip. The frame remains secured within the refrigeration unit.

Preferably, the means for hastening evaporation comprises a heating element, such as a coil, disposed near a bottom of the dissipator. The heating coil is connected to the dissipator means such that upon removal of the dissipator from the refrigeration unit, the heating element remains intact within the dissipator.

Preferably, means for detecting a selected level of condensate accumulated in the dissipator is provided, as well as means for activating the heating element when the selected level has been reached. Specifically, the means for detecting may comprise a guide stem which includes a magnetically activated reed switch. A magnetized float, slidably disposed along the guide stem, is provided. By remaining at water level, the float triggers the switch within the stem when the water level has cause the float to rise on the stem to the selected level. When the switch is triggered, the heating element will be activated in order to vaporize the water in the dissipator.

In this regard, safety means, comprising for example a light emitting diode electrically connected to the heating element, may be provided for indicating a safe time period in which the dissipator may be removed from the refrigeration unit.

BRIEF DESCRIPTION OF THE DRAWINGS

A better understanding of the present invention may be had by reference to the following detailed description, taken in connection with the accompanying drawings in which:

FIG. 2 shows a cross-sectional view of the apparatus shown in FIG. 1, taken along line 2—2 of FIG. 3, and illustrating, by phantom line, removal or insertion of the dissipator into the frame; and FIG. 3 shows a cross-sectional view of the condensate evaporator apparatus taken along line 3—3 of FIG. 2.

DETAILED DESCRIPTION

Figure 1:
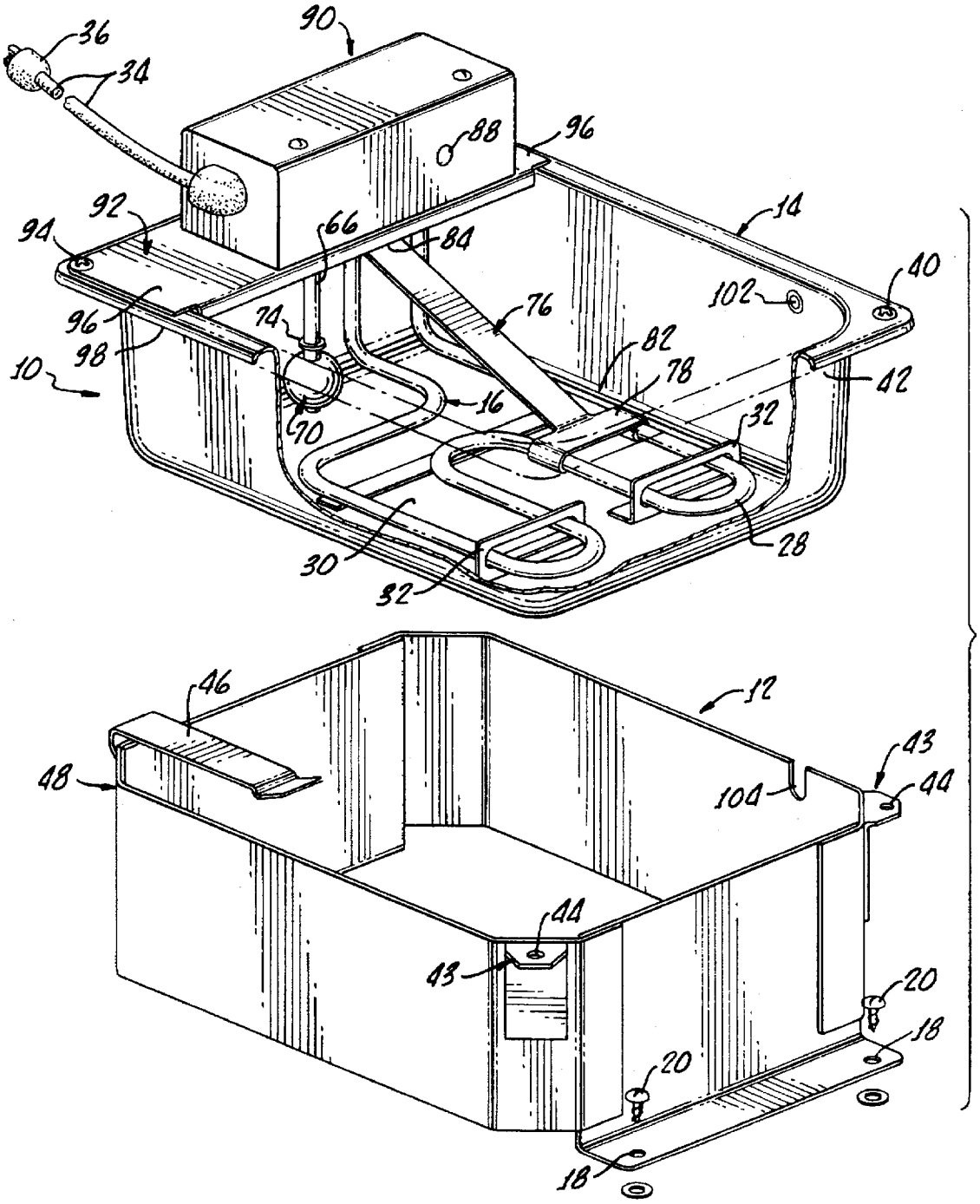
FIG. 1 shows an exploded, partial cross-sectional view of a condensate evaporator apparatus having a dissipator, heating element and frame, in accordance with the present invention, for a refrigeration unit.

Turning now to FIG. 1, a refrigerator condensate evaporator, in accordance with the present invention, is shown. Generally, the evaporator apparatus 10 comprises a frame 12, a dissipator 14 which provides means for receiving a condensate (not shown) dropping, or being pumped, from an evaporator coil, within a refrigeration unit (not shown), and means, including a heating element 16, for hastening evaporation of the condensate accumulated in the dissipator 14.

The frame 12 and dissipator 14 may be constructed of a suitable metal, such as stainless steel.

Apertures 18 within the frame 12, are provided for permanently mounting the frame within a refrigerated storage unit (not shown) by means of screws or bolts 20. Alternatively, the frame 12 may be welded or otherwise affixed to an appropriate surface within the refrigeration unit. It should be understood that the terminology "permanently mounting" refers to mounting with the intention that the frame should remain fixed within the refrigerator indefinitely, as there will normally be no need to remove the frame therefrom. Furthermore, it will be appreciated by those persons skilled in the refrigerator art that an appropriate surface for mounting the frame of the present invention would include a flat surface situated below evaporator coils of the refrigerator, said flat surface being where a conventional evaporator pan is normally placed.

The heating element 16 is disposed within and connected to the dissipator 14. Specifically, the heating element 16 may comprise a coil 28 disposed adjacent a bottom 30 of the dissipator 14 and stabilized by means of brackets 32, for example. The coil 28 of the heating element 16 receives current from a standard wall outlet by means of a cord 34 terminating with a standard three prong plug 36.

Once condensate has begun to accumulate in the dissipator 14, the heating element 16 functions to vaporize the condensate by thermal conduction. Operation of the heating element 16 will be described in greater detail hereinafter.

Unlike prior art condensate evaporators, which are typically permanently connected directly with electrical circuitry that powers the vaporizer compression cycle of the refrigerator, the three pronged plug 36 enables the apparatus to be electrically connected to a standard electrical wall outlet (not shown), separate from the refrigerator circuitry.

As shown in FIG. 1, width and length dimensions of the frame 12 substantially conform to width and length dimensions of the dissipator 14 such that when the apparatus is in use, the dissipator 14 nests within the frame 12 and receives drops of condensate falling from the evaporator coils (not shown) or condensate being pumped from the coils.

Turning now as well to FIG. 2, it is shown that the dissipator 14 is freely removable from the frame 12 for purposes of cleaning, maintenance or replacement of the dissipator or the heating element 16.

Generally the means for removably attaching the dissipator 14 to the frame 12 may include, for example, a pair of quick release fasteners 40 disposed on a proximal end 42 of the dissipator 14. Tabs 43 including apertures 44 are disposed on the frame 12 for fastening the quick release fasteners thereto.

In addition, a resilient clip 46 disposed on a distal end 48 of the frame 12 is provided which enables the dissipator 14 and heating element 16 to be slidably removed from the frame 12 upon manual release of the quick release fasteners 40.

In this particular embodiment, in order for the dissipator 14 to be removed from the frame 12, all that is required is that a user first manually grasp the two quick release fasteners 40, second, pull (or otherwise release) the fasteners 40 and third, slide the dissipator 14 from under the resilient clip 46, by tilting the dissipator 14 (in the direction of arrow 52) and pulling the fasteners 40 toward the user (in the direction of arrow 54). These three steps may be performed in a single fluid motion.

Importantly, the present invention is designed such that upon removal of the dissipator 14 as described above, only the frame 12 of the apparatus remains in the refrigerator unit. The balance of the apparatus 10, namely the dissipator 14, heating element 16, (and other components to be described hereinafter), is entirely and unitarily removed from the refrigeration unit.

For reasons of safety, electrical power to the apparatus 10 should be disconnected prior to any cleaning or repair thereof. The pronged plug 36 provides a simple means of disconnecting the heating element 16 from a power source while allowing the refrigerator unit to remain in operation.

Once the dissipator 14 and heating element 16 is removed from the frame 12, they may be cleaned or repaired as necessary. In the meantime, it is possible to insert another identical dissipator and heating element, in accordance with the present invention, into the frame 12, as a temporary or permanent replacement.

In order to attach the dissipator 14 into the frame 12, a user may simply slide the dissipator 14 into the frame 12 by tilting the dissipator 14 in the direction of arrows 56 and sliding it under the resilient clip 46 in the direction of arrow 58 and connecting the quick release fasteners 40.

Access to the dissipator, heating element and other components of the present apparatus is easily gained. Removal (or insertion) of the dissipator 14 may be performed by any person without the use of tools and without the need for special knowledge. This increases the likelihood that the apparatus will be cleaned and maintained regularly, thus extending the useful life thereof.

In one embodiment of the present invention, means are provided for detecting a selected level of the accumulated condensate in the dissipator 14 and means for activating the heating element 16 when the selected level has been reached.

Turning now to FIG. 3, it is shown that the means for detecting a selected level of condensate may comprise a guide stem 66, including a magnetically activated reed switch 68, and a magnetized float 70 slidably disposed along the guide stem 66. The magnetized float may be comprised of a sealed float in which is embedded a magnet (not shown).

The reed switch 68, which is embedded within the guide stem 66 at a position which represents the selected level, will be triggered once the magnetic float 70 has risen, by means of the accumulating condensate, to the selected level. Once the accumulated condensate has reached the selected level, the reed switch 68 is closed, allowing electrical current to run to a relay switch (not shown) on the how voltage side, activating the relay and allowing full AC current to heat the coil 28 of the heating element 16.

The float 70 may be limited in motion by means of a stop 74 such that the float will remain over the reed switch as long as the condensate level is at least at or above the selected level.

Upon vaporization of the condensate, the float 70 will drop below the selected level on the guide stem 66 at which point the reed switch will open, and current to the coil 28 will be discontinued.

Additionally, there may be included a heat conductive strap 76, made of copper for example, in contact with the heating element 16. More particularly, the strap 76 may include a band portion 78 disposed around a section of the coil 28 on one end 82 of the strap 76, and connected to a thermal activated switch (not shown) on another end 84 of the strap 76. This feature of the present invention provides means for disrupting the supply of AC current once the coil 28 has surpassed a selected high temperature level.

For example, if current continues to flow through the heating element 16 once the condensate has completely evaporated, the temperature of the heating element 16, naturally, will escalate. For safety reasons, the heat conductive strap 76 is provided in order to trigger the thermal switch to an off position, disrupting the flow of current, once the heating element 16 has surpassed the selected high temperature.

The hereinabove described relay switch and thermal activated switch may be disposed within a switch box 90 disposed on and connected to a shelf 92 spanning the width of the dissipator 14. The switch box 90 and shelf 92 may be fastened to the dissipator using any suitable means, for example by screws 94 or the like, connecting an edge 96 of the shelf 92 to a lip 98 of the dissipator 14.

As shown in FIGS. 1 and 3 a drainage tube 102 in the dissipator 14 leading to an overflow reservoir (not shown) may be provided, in the event that accumulating condensate should begin to overflow. A notch 104, defined in the frame 12, is provided for receiving the drainage tube 102.

Another feature of the present invention is a safety signal, electrically connected to the heating element 16, as means for providing an indication of a safe time period for removing the dissipator 14 from the refrigeration unit. For example, a light emitting diode (LED) 88 may be provided which is disposed on the switch box 80 at a clear viewing position and connected to a switch within the box 80.

For purposes of example only, when the heating element 16 is in operation, the LED 88 may be "on" in order to indicate to a user that the dissipator 14 should not be removed in order to avoid injury. Preferably, the LED will remain "on", even after power to the heating element 16 has been discontinued, until the coil 28 has cooled to a safe temperature. This may be accomplished by utilization of the heat conductive strap 76 and thermal activated switch within the switch box 80.

In a broad sense, the present invention encompasses an improved refrigerated storage enclosure of the type having a plurality of upstanding sidewalls at least one of which includes a doorway therethrough, a floor member beneath the sidewalls, a refrigerator compressor and condenser mounted within said enclosure and operatively connected to an evaporator coil for cooling the inside of said enclosure wherein the improvement comprises the condensate evaporator apparatus described hereinabove.

Although there has been hereinabove described a condensate evaporator apparatus, in accordance with the present invention, for the purpose of illustrating the manner in which the invention may be used to advantage, it will be appreciated that the invention is not limited thereto. Accordingly, all modifications, variations or equivalent arrangements which may occur to those skilled in the art should be considered to be within the scope of the invention as defined in the appended claims.

What is claimed is:

1. A condensate evaporator apparatus for a refrigeration unit, said condensate evaporator apparatus comprising:

dissipator means for receiving a condensate;

heating element means for hastening evaporation of the condensate accumulated in the dissipator means;

frame means for housing the dissipator means, said frame means including means for permanently securing said frame means within a refrigeration unit;

means for detecting a selected level of the accumulated condensate in the dissipator means;

means for activating the heating element when the selected level has been reached;

safety means, connected to the heating element means, for providing an indication of a safe time period for removing the dissipator means; and means for removably attaching said dissipator means within said frame means in order to enable the dissipator means to be freely inserted into and removed from the refrigeration unit, thus facilitating cleansing, maintenance and replacement of the dissipator means.

2. The condensate evaporator apparatus according to claim 1 wherein the means for removably attaching the dissipator means to the frame means comprises a pair of quick release fasteners on a proximal end of the dissipator means.

3. The condensate evaporator apparatus according to claim 2 wherein the means for removably attaching further comprises means, including a resilient clip on a distal end of the frame means, for enabling slidable removal of the dissipator means and heating element from the frame means during manual release of the quick release fasteners.

4. The condensate evaporator apparatus according to claim 1 wherein the means for detecting the selected level comprises a guide stem including a magnetically activated reed switch, and a magnetized float slidably disposed along said guide stem.

5. The condensate evaporator apparatus according to claim 1 wherein the safety means includes a light emitting diode electrically connected to the heating element.

6. An improved refrigerated storage enclosure of the type having a plurality of upstanding side walls at least one of which has a doorway therethrough, a floor member beneath said side walls, a refrigerator compressor and condenser mounted within said enclosure and operatively connected to an evaporator coil for cooling the inside of said enclosure, wherein the improvement comprises:

dissipator mens for receiving a condensate from said evaporative coil;

heating element means for hastening evaporation of the condensate accumulated in the dissipator means;

frame means for housing the dissipator means, said frame means including means for permanently securing said frame means to the refrigerated storage enclosure;

means for detecting a selected level of the accumulated condensate in the dissipator means;

means for activating the heating element when the selected level has been reached;

safety means, connected to the heating element means, for providing an indication of a safe time period for removing the dissipator means; and means for removably attaching said dissipator means within said frame means in order to enable the dissipator means to be freely inserted into and removed from the refrigerated storage enclosure, thus facilitating cleansing, maintenance and replacement of both the dissipator means and the means for hastening evaporation.

7. The improved refrigerated storage enclosure according to claim 6 wherein the means for removably attaching the dissipator means to the frame means comprises a pair of fasteners on a proximal end of the dissipator means.

8. The improved refrigerated storage enclosure according to claim 7 wherein the means for removably attaching further comprises means, including a resilient clip on a distal end of the frame means, for enabling slidable removal of the dissipator means and heating element from the frame means during manual release of the quick release fasteners.

9. The improved refrigerated storage enclosure according to claim 6 wherein the means for detecting the selected level comprises a guide stem including a magnetically activated reed switch, and a magnetized float slidably disposed along said guide stem.

10. The improved refrigerated storage enclosure according to claim 6 wherein the safety means includes a light emitting diode electrically connected to the heating element.

11. An improved refrigerated storage enclosure of the type having a plurality of upstanding side walls at least one of which has a doorway therethrough, a floor member beneath said side walls, a refrigerator compressor and condenser mounted within said enclosure and operatively connected to an evaporator coil for cooling the inside of said enclosure, wherein the improvement comprises:

dissipator means for receiving a condensate from said evaporative coil;

means, comprising a heating element, for hastening evaporation of the condensate accumulated in the dissipator means, said heating element being disposed within and connected to the dissipator means;

frame means for housing the dissipator means, said frame means including means for permanently securing said frame means to the refrigerated storage enclosure; and means for detecting a selected level of the accumulated condensate in the dissipator means and means for activating the heating element when the selected level has been reached, said means for detecting comprising a guide stem including a magnetically activated reed switch, and a magnetized float slidably disposed along said guide stem;

safety means, connected to the heating element, for providing an indication of a safe period for removing the dissipator means, said safety means including a light emitting diode electrically connected to the heating element; and means for removably attaching said dissipator means within said frame means in order to facilitate cleansing, maintenance and replacement of the dissipator means and means for hastening evaporation, said means for removably attaching including a pair of quick release fasteners disposed on a proximal end of the dissipator means, and means, including a resilient clip disposed on a distal end of the frame mens, for enabling slidable removal of the dissipator means and the heating element upon manual release of the quick release fasteners.

* * * * *